US008465276B2

(12) United States Patent
Prade

(10) Patent No.: US 8,465,276 B2
(45) Date of Patent: Jun. 18, 2013

(54) BURNER FOR FLUID FUELS AND METHOD FOR OPERATING SUCH A BURNER

(75) Inventor: Bernd Prade, Mülheim an der Ruhr (DE)

(73) Assignee: Siemens Aktiengesellschaft, München (DE)

( * ) Notice: Subject to any disclaimer, the term of this patent is extended or adjusted under 35 U.S.C. 154(b) by 1070 days.

(21) Appl. No.: 11/665,100

(22) PCT Filed: Sep. 23, 2005

(86) PCT No.: PCT/EP2005/054796

§ 371 (c)(1), (2), (4) Date: Apr. 10, 2007

(87) PCT Pub. No.: WO2006/040255

PCT Pub. Date: Apr. 20, 2006

(65) Prior Publication Data

US 2009/0061365 A1 Mar. 5, 2009

(51) Int. Cl.
*F23Q 9/00* (2006.01)

(52) U.S. Cl.
USPC ..... 431/278; 431/284; 431/285; 431/287; 431/12; 60/737; 60/775

(58) Field of Classification Search
USPC ..... 431/12, 278, 284, 285, 287
See application file for complete search history.

(56) References Cited

U.S. PATENT DOCUMENTS 2,217,975 A * 10/1940 Waisner et al. ..... 239/427.5
2,792,058 A * 5/1957 Thomas et al. ..... 431/3
3,015,449 A * 1/1962 Meyer ..... 239/417
3,174,527 A * 3/1965 Reed et al. ..... 431/181
3,382,679 A * 5/1968 Spoerlein ..... 60/267
3,890,088 A * 6/1975 Ferri ..... 431/351
4,025,282 A * 5/1977 Reed et al. ..... 431/11
4,342,198 A * 8/1982 Willis ..... 60/737
4,589,260 A * 5/1986 Krockow ..... 60/737
4,701,124 A * 10/1987 Maghon et al. ..... 431/284
4,838,029 A * 6/1989 Gleason et al. ..... 60/732
4,893,468 A * 1/1990 Hines ..... 60/775
4,910,957 A * 3/1990 Moreno et al. ..... 60/773
5,062,792 A * 11/1991 Maghon ..... 431/284
5,066,221 A * 11/1991 Becker ..... 431/280
5,094,610 A * 3/1992 Mandai et al. ..... 431/183
RE33,896 E * 4/1992 Maghon et al. ..... 431/284
5,247,792 A * 9/1993 Coffinberry ..... 60/39.463
5,343,691 A * 9/1994 Coffinberry ..... 60/776
5,351,477 A * 10/1994 Joshi et al. ..... 60/39.463
5,410,884 A * 5/1995 Fukue et al. ..... 60/267

(Continued)

FOREIGN PATENT DOCUMENTS

DE 42 12 810 A1 10/1992
DE 44 15 315 A1 11/1995
DE 101 60 907 A1 8/2003
EP 1 143 199 A1 10/2001

*Primary Examiner* — Kenneth Rinehart
*Assistant Examiner* — Jorge Pereiro

(57) ABSTRACT

Disclosed is a method for operating a burner for fluid fuels. According to said method, the fluid fuel is mixed with an oxidizer before the fluid fuel is burned. The inventive method is characterized in that a liquid fuel that is used as a fluid fuel is mixed with a gaseous or vaporous carrier flow before being mixed with the oxidizer while the carrier flow containing the liquid fuel is mixed with the oxidizer in order to mix the liquid fuel with the oxidizer.

10 Claims, 2 Drawing Sheets

U.S. PATENT DOCUMENTS 5,451,160 A * 9/1995 Becker ..... 431/284
5,511,375 A * 4/1996 Joshi et al. ..... 60/39.463
5,617,716 A * 4/1997 Schreiber et al. ..... 60/775
5,647,538 A * 7/1997 Richardson ..... 239/405
5,758,865 A * 6/1998 Casey ..... 251/129.21
5,816,049 A * 10/1998 Joshi ..... 60/737
6,038,864 A * 3/2000 Prade et al. ..... 60/748
6,109,038 A * 8/2000 Sharifi et al. ..... 60/737
6,152,724 A * 11/2000 Becker ..... 431/9
6,189,320 B1 * 2/2001 Poeschl et al. ..... 60/737
6,202,401 B1 * 3/2001 Seume et al. ..... 60/776
6,247,299 B1 * 6/2001 Buss et al. ..... 60/776
6,267,583 B1 * 7/2001 Mandai et al. ..... 431/285
6,357,217 B1 * 3/2002 Griffin ..... 60/780
6,367,239 B1 * 4/2002 Brown et al. ..... 60/775
6,374,593 B1 * 4/2002 Ziegner ..... 60/772
6,632,084 B2 * 10/2003 Berenbrink ..... 431/284
6,978,619 B2 * 12/2005 Blomeyer ..... 60/776
7,003,957 B2 * 2/2006 Griffin et al. ..... 60/737
7,029,272 B2 * 4/2006 Jordan et al. ..... 431/278
7,051,530 B2 * 5/2006 Blomeyer ..... 60/737
7,246,493 B2 * 7/2007 Flohr et al. ..... 60/725
7,320,222 B2 * 1/2008 Flohr et al. ..... 60/725
7,370,478 B2 * 5/2008 Rocca ..... 60/776
7,448,218 B2 * 11/2008 Heilos et al. ..... 60/776
7,540,710 B2 * 6/2009 Grote et al. ..... 415/200
2001/0018173 A1 * 8/2001 Tiemann ..... 431/284
2001/0024774 A1 * 9/2001 Berenbrink ..... 431/284
2002/0056276 A1 5/2002 Dalla Betta et al.
2004/0055270 A1 * 3/2004 Blomeyer ..... 60/39.12
2004/0055308 A1 * 3/2004 Blomeyer ..... 60/737
2004/0131986 A1 * 7/2004 Stalder et al. ..... 431/278
2004/0142294 A1 * 7/2004 Niass et al. ..... 431/278
2005/0079464 A1 * 4/2005 Jordan et al. ..... 431/278
2005/0091986 A1 * 5/2005 Gerhold ..... 60/775
2007/0033947 A1 * 2/2007 Rocca ..... 60/776
2007/0099142 A1 * 5/2007 Flohr et al. ..... 431/354
2007/0141519 A1 * 6/2007 Lauer ..... 431/11
2007/0231762 A1 * 10/2007 Bernero et al. ..... 431/350
2008/0044782 A1 * 2/2008 Kostlin et al. ..... 431/284
2009/0061365 A1 * 3/2009 Prade ..... 431/11

* cited by examiner

BURNER FOR FLUID FUELS AND METHOD FOR OPERATING SUCH A BURNER

CROSS REFERENCE TO RELATED APPLICATIONS

This application is the US. National Stage of International Application No. PCT/EP2005/054796, filed Sep. 23, 2005 and claims the benefit thereof. The International Application claims the benefits of European application No. 04024185.3 filed Oct. 11, 2004, both of the applications are incorporated by reference herein in their entirety.

FIELD OF INVENTION

The present invention relates to a burner for fluid fuels which is to be operated in particular either with a gaseous or a liquid fuel as the fluid fuel and in which, prior to burning of the fluid fuel, the fluid fuel is mixed with an oxidizing agent. The present invention also relates to a method for operating such a burner. The burner according to the invention and the method according to the invention are particularly suitable for use in gas turbine systems.

BACKGROUND OF THE INVENTION

In a combustion chamber of a gas turbine system, an air-fuel mixture is burned whose exhaust gases cause the turbine of the gas turbine system to rotate, thereby converting the thermal energy of the combustion process into mechanical energy. For burning the air-fuel mixture, the combustion chamber is equipped with burners. The burners cause the fuel to be mixed with the air and the mixture to be combusted.

In order to ensure the reliability of supply and the flexibility of a gas turbine system, burners are nowadays used which can be operated with both gaseous fuels and liquid fuels. Such a burner is disclosed, for example, in DE 42 12 810 A1.

In view of the general efforts to reduce the pollutant emission of gas turbines, it is endeavored to avoid producing pollutants, particularly nitrogen oxides ($NO_X$). The nitrogen oxides are essentially produced during the combustion process by molecular oxygen and molecular nitrogen being broken down and the atomic oxygen and atomic nitrogen then reacting with molecular nitrogen and molecular oxygen respectively to form nitrogen oxides.

In order to minimize the amount of nitrogen oxides formed particularly in the high load range, modern gas turbine systems are operated in what is known as premix mode. This means that the fuel is already mixed with air prior to ignition. This is in contrast to diffusion mode in which fresh air is fed to a burning air-fuel mixture and fuel is after-injected, the mixing of the fuel with the air not taking place until combustion. Diffusion mode is essentially employed during low-load operation and when starting up gas turbine systems. The different operating states of a gas turbine system are described e.g. in M. J. Moore "$NO_x$ emission control in gas turbines for combined cycle gas turbine plant" in Proc Instn Mech Engrs Vol 211, Part A, 43-52". This also describes how inert substances such as water or steam can be added to the combustion mixture in gas turbine systems to reduce the pollutant emission in particular operating states. The water or steam then reduces the combustion temperature, which likewise brings about a reduction in the amount of nitrogen oxides.

The burner described in DE 42 12 810 can be operated in premix mode with both liquid fuels and gaseous fuels. For this purpose it comprises at least one liquid fuel line feeding into the air supply duct of the burner and at least one gaseous fuel line feeding into the air supply duct. The fuel lines are each assigned outlet ports through which the relevant fuel can be sprayed into the air stream leading to the burner, the outlet ports being adapted to suit the fuel supplied by means of the relevant fuel pipes in such a way that the fuel is well mixed with the combustion air flowing to the burner.

DE 44 15 315 A1 shows a burner wherein, prior to combustion of the air-gas mixture in a combustion chamber, liquid fuel is mixed with steam.

EP 1 143 199 A1 shows a combustor which is implemented as a lean premix combustor, wherein water and steam are injected into the combustor.

DE 101 60 907 A1 shows a burner wherein an operating mode for significantly reducing thermoacoustic vibrations is achieved by adding the fuel to the combustion stream and adapting the velocity of the fuel to the velocity of the flow of combustion air.

SUMMARY OF INVENTION

Compared to the above-described prior art, an object of the present invention is to provide an advantageous method for operating a burner, and an advantageous burner.

The first object is achieved by a method for operating a burner for fluid fuels as claimed in the claims and the second object by a burner for fluid fuels as claimed in the claims. The dependent claims contain advantageous developments of the invention.

In the method according to the invention for operating a burner for fluid fuels, the fluid fuel is mixed with an oxidizing agent prior to combustion of the fluid fuel, i.e. combustion takes place in premix mode. Any agent capable of oxidizing the fuel, particularly air, is suitable as an oxidizing agent. The method according to the invention can in particular also be contrived so that either liquid fuels, i.e. all combustible liquids such as oil, methanol, etc., or gaseous fuels, i.e. all combustible gases such as natural gas, coal gas, propane, methane gas, etc., can be used as the fluid fuel. The method according to the invention is characterized in that a liquid fuel used as a fluid fuel is mixed with a gaseous or vaporous carrier stream prior to mixing with the oxidizing agent and, in order to mix the fluid fuel with the oxidizing agent, the carrier stream containing the liquid fuel is mixed with the oxidizing agent.

The method according to the invention allows the same nozzle system as that also used for mixing a gaseous fuel with the oxidizing agent to be used for mixing the fuel with the oxidizing agent—i.e. for mixing the carrier stream containing the fuel with the oxidizing agent. Special supply ports for feeding the liquid fuel into the mixing zone, i.e. the region where mixing of the fuel with the oxidizing agent takes place, do not need to be present. The constructional design of the burner can therefore be simplified, particularly in the area of the fuel supply ducts.

It is particularly advantageous if, prior to the mixing of the liquid fuel with the carrier stream, said carrier stream is superheated, as this causes the liquid fuel to vaporize more easily. A vaporous fuel can be mixed particularly well with the oxidizing agent by means of the supply ports provided for the gaseous fuel. This also enables temperature peaks during combustion to be better prevented.

In order to prevent the carrier stream from affecting the fuel-to-oxidizing-agent ratio during combustion, it is advantageous if the carrier stream is largely free from molecular oxygen. It is particularly advantageous if the carrier stream contains no molecular oxygen at all. Molecular nitrogen or steam are particularly suitable as the gas or vapor for the carrier stream.

In order to achieve good mixing of the liquid fuel with the gaseous or vaporous carrier stream, the liquid fuel can be mixed with the carrier stream by spraying the liquid fuel into the carrier stream. During spraying, the liquid fuel is finely atomized into the carrier stream.

A burner for fluid fuels according to the invention in which, prior to combustion of the fluid fuel, the fluid fuel is mixed with an oxidizing agent, and which can also be contrived to operate optionally with a gaseous or liquid fuel as the fluid fuel, comprises a liquid fuel supply, a gas supply, an oxidizing agent supply and a mixing passage which is connected directly or indirectly to the liquid fuel supply, the gas supply and the oxidizing agent supply and in which the fluid fuel is mixed with the oxidizing agent.

The burner according to the invention is characterized in that the fuel supply for feeding liquid fuels and the gas supply are disposed relative to one another in such a way that, prior to the entry of a liquid fuel into the mixing passage, the liquid fuel can be mixed with a gaseous or vaporous carrier stream supplied by means of the gas supply. In the burner according to the invention, the gas supply is therefore used both for feeding gaseous fuel (if the burner is operated with a gaseous fuel) and for feeding an inert gaseous or vaporous medium forming the gaseous or vaporous carrier stream (if the burner is operated with a liquid fuel).

The burner according to the invention enables in particular a liquid fuel to be mixed with a gaseous or vaporous carrier stream before it enters the mixing passage and then enables this mixture to be fed to the mixing passage for mixing with the oxidizing agent. With the described embodiment of the burner, the number of supply lines and in particular the number of inlet ports into the mixing passage can be reduced, as the same inlet ports to the mixing passage can be used for the gaseous fuel as for the liquid fuel (in the carrier stream). Separate inlet ports for liquid fuels can therefore be dispensed with in the burner according to the invention. In particular the inlet ports designed for the gaseous fuel also ensure a high spatial mixing potential for mixing the carrier stream containing the liquid fuel with the oxidizing agent.

If the gas or vapor of the carrier stream is superheated, this facilitates partial or complete vaporization of the liquid fuel, thereby enabling temperature peaks to be better prevented.

In a further embodiment of the burner according to the invention, the liquid fuel supply feeds into the gas supply via one or more atomizers, e.g. injection nozzles. The atomizers enable the liquid fuel to be atomized as it enters the carrier stream. Atomization produces good mixing and also facilitates vaporization of the liquid fuel because of the small dimensions of the fuel droplets produced during atomization. Altogether this enables the maximum possible combustion temperature and therefore the $NO_X$ emission to be reduced.

In another embodiment of the burner according to the invention, the gas supply can feed into the mixing passage via a gas nozzle system. By means of said gas nozzle system, the gaseous fuel or the carrier stream containing the liquid fuel can be physically very well mixed with the oxidizing agent.

In the region of the mixing passage, vanes for swirling the oxidizing agent which have cavities connected to the gas supply can be provided. At least some of the gas nozzles of the gas nozzle system feeding into the mixing passages are in this case connected to the swirler vane cavities and therefore to the gas supply. The fuel can thus be injected in particular into the turbulent zone produced by the swirler vanes, which promotes mixing of the fuel with the oxidizing agent.

Alternatively, nozzle tubes can also be provided in the region of the mixing passage which have cavities connected to the gas supply. At least some of the gas nozzles of the gas nozzle system feeding into the mixing passage are then connected to the gas supply via the nozzle tube cavities.

It is obviously also possible to dispose swirler vanes with gas nozzles as well as tubes with gas nozzles in the region of the mixing passage.

BRIEF DESCRIPTION OF THE DRAWINGS

Further features, characteristics and advantages of the present invention will emerge from the following description of exemplary embodiments with reference to the accompanying drawings in which FIG. 1 schematically illustrates a first embodiment of a burner according to the invention.

DETAILED DESCRIPTION OF INVENTION

Figure 1:
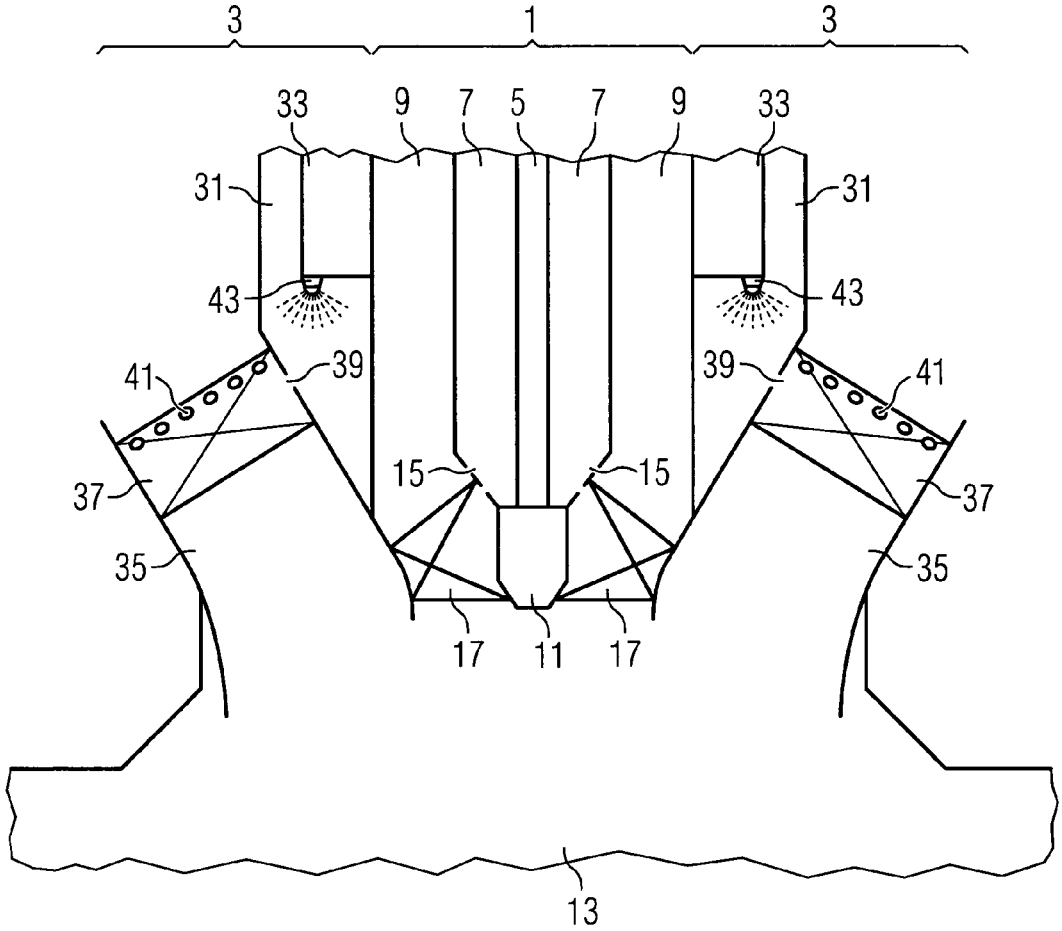

FIG. 1 shows a sectional view of a first embodiment of the burner according to the invention. The burner according to the invention comprises an inner burner system 1, hereinafter referred to as a pilot burner system 1, and a main burner system 3 disposed concentrically around the pilot burner system 1. The pilot burner system 1 comprises an inner supply duct 5 for liquid fuels, an inner gas supply duct 7 for gaseous fuels and an inner air supply duct 9, the inner gas supply duct 7 being disposed concentrically around the inner supply duct 5 for the liquid fuels. The inner air supply duct 9 is disposed concentrically around the gas supply duct 7.

The inner supply duct 5 for liquid fuels feeds into the combustion chamber 13 via a nozzle 11. The inner gas supply duct 7 feeds via outlet ports 15 into the air supply duct 9 in which swirler vanes 17 are disposed which are used for swirling the air-gas mixture resulting from the entry of the gas into the air, thereby ensuring good mixing of the two components. In or on the inner air supply duct 9 there can be disposed a suitable ignition system which is not shown here.

The pilot burner system 1 is used for maintaining a pilot flame supporting the stability of the burner flame and basically allows the burner to be operated as a diffusion burner or rich premixed burner, which, however, is not generally employed for pollutant emission reasons.

The main burner system 3 disposed concentrically around the pilot burner system 1 comprises a gas supply duct 31, one or more supply ducts 33 for a liquid fuel as well as at least one air supply duct 35 as an oxidizing agent supply duct. In this example air is used as the oxidizing agent. The supply duct for liquid fuel feeds into the gas supply duct 31 via nozzles 43.

In the air supply duct 35 are disposed swirler vanes 37 which swirl the air stream flowing through the air supply duct 35 in the direction of the combustion chamber 13. This part of the air supply duct 35 constitutes a mixing passage for mixing the fuel with the air as oxidizing agent.

At least some of the swirler vanes 37 are of hollow design. The cavities of the swirler vanes 37 are connected to the outer gas supply duct 31 via openings 39. At suitable locations the swirler vanes 37 have outlet ports 41 through which a gas fed via the gas supply duct 31 can enter the air supply duct 35. The outlet ports 41 are implemented as nozzles and are disposed in such a way that the gas, together with the air, still passes at least some of the swirler vanes 37 and is thus swirled to achieve good mixing with the air.

For operation of the burner with gas, gaseous fuel such as natural gas is fed through the gas supply duct 31 into the air supply duct 35, the swirler vanes 37 disposed in the air supply duct 35 ensuring that the gaseous fuel is mixed with the air so that the burner is to be operated in premix mode.

If the burner is to be operated with a liquid fuel such as heating oil, the liquid fuel is fed via the supply duct 33 for liquid fuels and atomized into the gas supply duct 31 by means of nozzles 43. In the case of operation with liquid fuel, an inert gas such as molecular nitrogen or a vapor such as steam is fed through the gas supply duct 31. Atomization of the liquid fuel for injection into the gas supply duct 31 results in gas/liquid mixing with finely dispersed liquid droplets. At least some of the liquid fuel droplets vaporize so that some of the fuel is present in the gas phase after atomization into the gas supply duct 31. The transition of the liquid fuel to the gas phase can be promoted by preheating the supplied inert gas or the supplied vapor and/or fuel. Complete vaporization of the atomized liquid fuel can also be achieved in this way. Preheating of the carrier medium to a defined temperature can also be used to pulse-control the mixing quality of the mixture.

The inert gas or vapor is used as the carrier stream for the liquid fuel droplets or liquid fuel passing to the gas phase. The carrier stream containing the fuel then flows like a gaseous fuel through the ports 39 into the cavities of the swirler vanes 37 where it is sprayed through the outlet ports 41 into the air supply duct 35, the swirler vanes 37 ensuring that the carrier stream is swirled with the air, thereby ensuring good mixing of the fuel contained in the carrier stream with the air as oxidizing agent. The burner is therefore also able to be operated in premix mode for operation with liquid fuel.

In the burner described with reference to FIG. 1, the spraying of the fuel into the air supply duct 35 takes place independently of the type of fuel—i.e. regardless of whether a liquid fuel or a gaseous fuel is used—by means of the outlet ports 41 used hitherto for spraying in gaseous fuel. A liquid fuel is first sprayed via the nozzles 43 into a carrier stream which is fed via the gas supply duct 31. The liquid fuel is then taken up by the carrier stream as vaporized fuel or as finely dispersed fuel in the form of suspended droplets and sprayed through the outlet ports 41 into the air supply duct 35. An additional outlet port or injection nozzle for feeding liquid fuel into the air supply duct 35 is not therefore necessary in the burner according to the invention.

Figure 2:
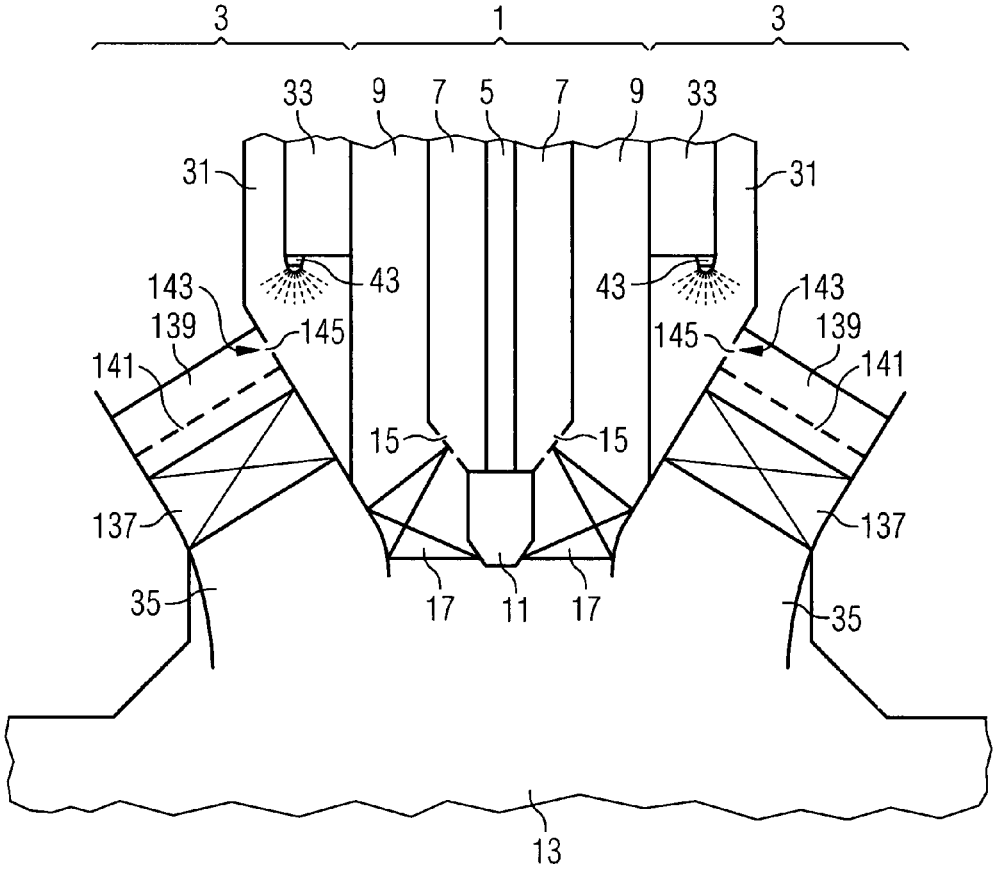
FIG. 2 schematically illustrates a second embodiment of a burner according to the invention.

A second exemplary embodiment of the burner according to the invention is shown in FIG. 2. The burner shown in FIG. 2 only differs from the burner shown in FIG. 1 in that the swirler vanes 137 have no cavities, i.e. the swirler vanes 137 are not designed as hollow vanes, and that nozzle tubes 139 are disposed in the air inlet duct 35. The nozzle tubes 139 are implemented as hollow tubes with one open face 143 adjoining an outlet port 145 of the gas supply duct 31. Each of the nozzle tubes 139 has a number of nozzles 141 via which a gaseous fuel fed via the gas supply duct 31 and the cavity of the nozzle tubes 139 is sprayed into the air supply duct 35 if the burner is operated with gaseous fuel. On the other hand, if the burner is operated with a liquid fuel, a carrier stream with finely dispersed fuel droplets or with vaporized fuel is sprayed into the air supply duct 35, the liquid fuel being sprayed into the carrier stream as described with reference to FIG. 1.

The invention claimed is:

1. A burner for fluid fuels where prior to combustion of the fluid fuel the fluid fuel is mixed with an oxidizing agent, comprising:

a fluid fuel supply that provides a liquid fuel for the burner;

a gas supply that provides a gaseous fuel or a carrier stream for the burner;

an oxidizing agent supply that provides an oxidizing agent for the burner; and a mixing passage directly connected to the fluid fuel supply, the gas supply and the oxidizing agent supply, the mixing passage being where the liquid fuel, carrier gas and oxidizing agent are mixed or where the gaseous fuel and oxidizing agent are mixed, wherein the fluid fuel supply and the gas supply are arranged such that the liquid fuel is injected in particulate form into the gas supply wherein the gas supply is used as a carrier stream for the liquid fuel in particulate form passing into a gas phase, wherein a mixing of the carrier stream containing the liquid fuel with the oxidizing agent is provided in the oxidizing agent supply which is connected to the gas supply, causing the liquid fuel to be mixed with the oxidizing agent in the oxidizing agent supply, wherein swirling vanes are arranged in the mixing passage such that the oxidation agent is at least partially swirled with the gaseous fuel or with the carrier stream containing the liquid fuel, and wherein the resulting mixture is fed into a combustion chamber, wherein the carrier stream is vaporous, wherein the vapor for the carrier stream is steam and free of molecular oxygen, and wherein the burner is operated with either liquid or gaseous fuels.

2. The burner as claimed in claim 1, wherein the gas supply supplies a gas or vapor.

3. The burner as claimed in claim 2, wherein the vapor of the carrier stream is superheated.

4. The burner as claimed in claim 1, wherein the gas supply feeds into the mixing passage via a gas nozzle system which is used for mixing a gaseous fuel with the oxidizing agent and for mixing the carrier stream comprising a liquid fuel with the oxidizing agent.

5. The burner as claimed in claim 4, wherein in a region of the mixing passage swirler vanes are provided which have cavities connected to the gas supply, and at least some of the gas nozzles of the gas nozzle system that feed into the mixing passage are connected to the gas supply via the cavities of the swirler vanes.

6. The burner as claimed in claim 5, wherein in the region of the mixing passage nozzle tubes are provided that have cavities connected to the gas supply and at least some of the gas nozzles of the gas nozzle system which feed into the mixing passage are connected to the gas supply via the cavities of the nozzle tubes.

7. A method for operating a burner, comprising:

supplying a fluid fuel comprising a gaseous fuel in a first supply duct or supplying a fluid fuel comprising injecting a liquid fuel in particulate form via a nozzle into a vaporous carrier stream supplied in the first supply duct;

introducing an oxidizing agent into a second supply duct;

mixing the gaseous fuel or the carrier stream containing the liquid fuel with the oxidizing agent in the second supply duct that is connected to the first supply duct;

swirling the gaseous fuel or the carrier stream containing the liquid fuel with the oxidizing agent via swirling vanes; and feeding the mixture into a combustion chamber, wherein steam is the basis of the vaporous carrier stream, and wherein the burner is operated with either liquid or gaseous fuels, wherein the gaseous fuel or the carrier stream containing the liquid fuel feeds into the second supply duct via a gas nozzle system, and wherein the same gas nozzle system is used both for mixing the gaseous fuel with the oxidizing agent and for mixing the carrier stream comprising the liquid fuel with the oxidizing agent.

8. The method as claimed in claim 7, wherein the carrier stream is superheated prior to mixing the fluid fuel with the carrier stream.

9. The method as claimed in claim 8, wherein the mixing quality of the fluid fuel in the carrier stream is set by selecting the mass flow and/or the temperature of the carrier medium.

10. The method as claimed in claim 9, wherein the vapor for the carrier stream is essentially free of molecular oxygen.

* * * * *